US009595758B2

(12) United States Patent
Flores-Cuadras

(10) Patent No.: US 9,595,758 B2
(45) **Date of Patent: *Mar. 14, 2017**

(54) DUAL-BAND, SERIES-ALIGNED ANTENNA, METHOD OF MANUFACTURE AND KITS THEREFOR

(71) Applicant: TAOGLAS GROUP HOLDINGS, Enniscorthy, County Wexford (IE)

(72) Inventor: Javier Ruben Flores-Cuadras, Tijuana (MX)

(73) Assignee: TAOGLAS GROUP HOLDINGS, Enniscorthy (IE)

( * ) Notice: Subject to any disclaimer, the term of this patent is extended or adjusted under 35 U.S.C. 154(b) by 0 days.

This patent is subject to a terminal disclaimer.

(21) Appl. No.: 14/976,615

(22) Filed: Dec. 21, 2015

(65) Prior Publication Data

US 2016/0111783 A1 Apr. 21, 2016

Related U.S. Application Data

(63) Continuation of application No. 14/000,313, filed as application No. PCT/US2012/023463 on Feb. 1, 2012, now Pat. No. 9,252,486.

(Continued)

(51) Int. Cl.

*H01Q 1/48* (2006.01)
*H01Q 5/30* (2015.01)

(Continued)

(52) U.S. Cl.

CPC ..... *H01Q 5/30* (2015.01); *H01Q 1/2291* (2013.01); *H01Q 1/40* (2013.01); *H01Q 1/48* (2013.01);

(Continued)

(58) Field of Classification Search

CPC ..... H01Q 5/01; H01Q 1/2291; H01Q 1/40; H01Q 5/10; H01Q 5/364

See application file for complete search history.

(56) References Cited

U.S. PATENT DOCUMENTS 4,441,498 A 4/1984 Nordling
4,894,663 A 1/1990 Urbish et al.

(Continued)

FOREIGN PATENT DOCUMENTS

EP 1079463 A2 10/2001
EP 1717902 A1 11/2006

(Continued)

*Primary Examiner* — Trinh Dinh

(74) *Attorney, Agent, or Firm* — Shartsis Friese LLP; Cecily Anne O'Regan

(57) ABSTRACT

A planar monopole antenna for dual-band Wi-Fi application is disclosed. The antenna has a ground copper and a radiation copper. The radiation copper is adhered to a substrate and has a conductive layer attached to a first surface of the substrate wherein the conductive layer further comprises a first radiation control section operating at a first bandwidth and connected in series via a central post with a second radiation control section operating at a second bandwidth different than the first bandwidth, and a ground section having a rectangularly-shaped pattern with a U-shaped opening at one end thereof positioned around a portion of the second radiation control section, wherein the planar antenna has a current distribution that is higher along the central post and a squared end of the rectangularly shaped ground section. Reception of the radiation copper into the opening of the ground copper forms an U-shaped separation that is approximately 0.6 mm wide. The antenna has a gross span of approximately 45 mm and a width of approximately 7 mm.

28 Claims, 5 Drawing Sheets

Related U.S. Application Data

(60) Provisional application No. 61/440,711, filed on Feb. 8, 2011.

(51) Int. Cl.

| | |
|---|---|
| ***H01Q 1/22*** | (2006.01) |
| ***H01Q 1/40*** | (2006.01) |
| ***H01Q 9/40*** | (2006.01) |
| ***H01Q 5/10*** | (2015.01) |
| ***H01Q 5/364*** | (2015.01) |

(52) U.S. Cl.
CPC ..... *H01Q 5/10* (2015.01); *H01Q 5/364* (2015.01); *H01Q 9/40* (2013.01)

(56) References Cited

U.S. PATENT DOCUMENTS

| | | | | |
|---|---|---|---|---|
| D318,673 | S | 7/1991 | Terk | |
| D345,564 | S | 3/1994 | Kadono et al. | |
| D350,963 | S | 9/1994 | Witzky | |
| D379,356 | S | 5/1997 | Liu et al. | |
| D405,090 | S | 2/1999 | Guttadauro | |
| 6,049,314 | A | 4/2000 | Munson et al. | |
| D440,960 | S | 4/2001 | Barber | |
| 6,346,914 | B1 | 2/2002 | Annamaa | |
| D465,479 | S | 11/2002 | Tourres | |
| 6,661,380 | B1 | 12/2003 | Bancroft et al. | |
| 6,917,339 | B2 | 7/2005 | Li et al. | |
| D516,443 | S | 3/2006 | Gotou et al. | |
| D531,172 | S | 10/2006 | Noro et al. | |
| D531,173 | S | 10/2006 | Aizawa et al. | |
| D533,546 | S | 12/2006 | Iizuka et al. | |
| D535,647 | S | 1/2007 | Hall et al. | |
| 7,161,536 | B2 | 1/2007 | Hilgers | |
| D536,695 | S | 2/2007 | Griffin | |
| 7,248,227 | B2 * | 7/2007 | Chen | H01Q 1/38 343/700 MS |
| D571,793 | S | 6/2008 | Wu et al. | |
| D599,753 | S | 9/2009 | Cho et al. | |
| D606,052 | S | 12/2009 | Noro et al. | |
| D610,102 | S | 2/2010 | Cho et al. | |
| D614,610 | S | 4/2010 | Sala et al. | |
| 7,864,121 | B2 | 1/2011 | Suprunov et al. | |
| D635,535 | S | 4/2011 | Cho et al. | |
| D641,365 | S | 7/2011 | Lee et al. | |
| D648,712 | S | 11/2011 | Brickstad | |
| D649,151 | S | 11/2011 | Ramones et al. | |
| D655,720 | S | 3/2012 | Andre et al. | |
| D659,692 | S | 5/2012 | Jung et al. | |
| D662,905 | S | 7/2012 | Bang et al. | |
| D664,127 | S | 7/2012 | Yang | |
| 8,279,133 | B2 * | 10/2012 | Shimoda | H01Q 1/243 343/700 MS |
| D683,730 | S | 6/2013 | Akana et al. | |
| 2003/0098812 | A1 | 5/2003 | Ying et al. | |
| 2003/0112188 | A1 | 6/2003 | Bordi et al. | |
| 2004/0169611 | A1 | 9/2004 | Korva | |
| 2005/0200556 | A1 | 9/2005 | Lin et al. | |
| 2005/0237244 | A1 | 10/2005 | Annabi et al. | |
| 2005/0280580 | A1 | 12/2005 | Lin | |
| 2006/0038721 | A1 | 2/2006 | Ozkar et al. | |
| 2007/0096995 | A1 | 5/2007 | Lee | |
| 2007/0097008 | A1 * | 5/2007 | Chen | H01Q 1/38 343/795 |
| 2007/0115183 | A1 | 5/2007 | Kim et al. | |
| 2008/0042906 | A1 | 2/2008 | Yanagi et al. | |
| 2008/0062047 | A1 | 3/2008 | Iwata et al. | |
| 2008/0252636 | A1 | 10/2008 | Servantie et al. | |
| 2008/0266189 | A1 | 10/2008 | Wu | |
| 2010/0141541 | A1 | 6/2010 | Kuramoto | |
| 2011/0068996 | A1 | 3/2011 | Flores-Cuadras et al. | |
| 2011/0122045 | A1 | 5/2011 | Seo et al. | |
| 2012/0206301 | A1 | 8/2012 | Flores-Cuadras et al. | |
| 2012/0326943 | A1 | 12/2012 | Flores-Cuadras et al. | |

FOREIGN PATENT DOCUMENTS

| | | | |
|---|---|---|---|
| EP | 2096904 | A1 | 9/2009 |
| EP | 2280448 | A1 | 2/2011 |
| EP | 2538489 | A1 | 12/2012 |
| GB | 2317994 | A | 4/1998 |
| WO | 2012071315 | A2 | 8/2012 |
| WO | 2012109067 | A2 | 8/2012 |
| WO | 2012118636 | A2 | 9/2012 |
| WO | 2012071266 | A2 | 12/2012 |

* cited by examiner

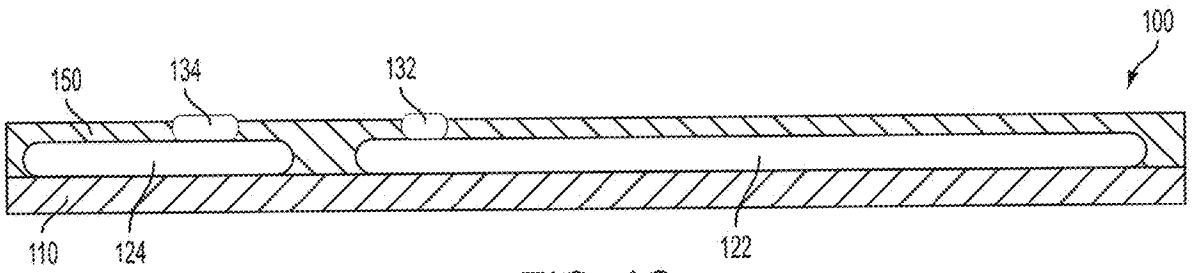
FIG. 1C
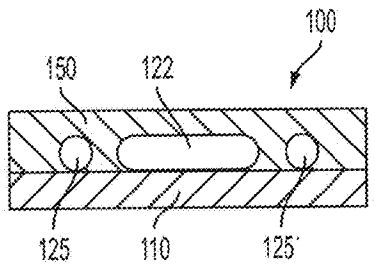
FIG. 1D
FIG. 1E
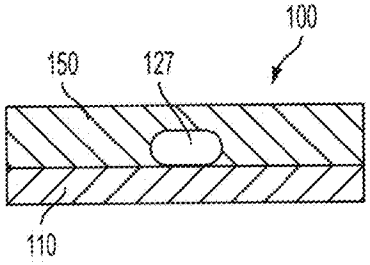
FIG. 1F
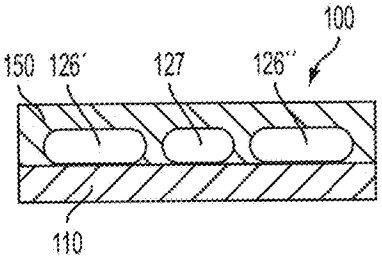
FIG. 1G

DUAL-BAND, SERIES-ALIGNED ANTENNA, METHOD OF MANUFACTURE AND KITS THEREFOR

CROSS-REFERENCE

This application is a continuation application of U.S. patent application Ser. No. 14/000,313, filed Feb. 1, 2013, which is the National Stage of International Patent Application No. PCT/US12/23463, filed Feb. 1, 2012, which claims the benefit of U.S. Provisional Application No. 61/440,711, filed Feb. 8, 2011, which applications are incorporated herein by reference.

BACKGROUND OF THE INVENTION

Field of the Invention

The present invention relates in general to an antenna and, in particular, to a planar antenna. More particularly, the present invention relates to a coupled dual-band dipole antenna having an interference-cancellation gap for wireless applications such as Wi-Fi™, wireless HDTV, Bluetooth, Public Safety, RFID, WIMAX, tolling, remote control and unlicensed band wireless applications. The invention is suitable for use in any wireless application, including, but not limited to those which use 2400-2500 MHz and 4900-6000 MHz bands.

Background of the Invention

In recent years there has been a tremendous increase in the use of wireless devices. The increased use has filled all or nearly all existing frequency bands. As a result, new wireless frequency standards continue to emerge throughout the world.

Based on the IEEE 802.11 standards, Wi-Fi™ has become the de facto standard for wireless local area network (WLAN) devices, which includes cell phones, smart phones and PDA devices, and laptop and desktop personal computers. Extensive efforts have been devoted to the development of an antenna that can be used to cover the entire frequency range of the latest Wi-Fi™ standard to keep overall device costs down by not requiring two separate antennas for each band while still maintaining optimal efficiency and gain in both bands.

For the latest dual-band Wi-Fi antennas, increased interference is problematic in the 2.4 and 5 GHz frequency modes. It has also been difficult for a single antenna to be optimized for both frequency modes. Currently antennas are either optimized for one frequency or another or performance in both modes results in poor efficiency. Previously disclosed planar antennas include, for example, those disclosed in U.S. Pat. No. 6,917,339 B2 to Li et al. for Multi-Band Broadband Planar Antennas; U.S. Pat. No. 6,346,914 B1 to Annamaa for Planar Antenna Structure

SUMMARY OF THE INVENTION

An aspect of the disclosure is directed to planar antennas. Planar antennas typically comprise: a substrate; a conductive layer attached to a first surface of the substrate wherein the conductive layer further comprises an antenna section which includes a ground section having a substantially rectangular shape with a U-shaped opening (female aperture) along one length in two dimensions, and an elongated radiation section configured to fit within the female aperture of the ground section at a first end and an arrowhead shape (or M-shape) at a second end. Each of the antenna section and the ground section can be formed from a layer of patterned foil adhered to the first surface of the substrate. As shown, the antenna section and the ground section have a combined overall width of from about 30 mm to 58 mm and a height of from about 3 mm to about 15 mm, and more preferably the antenna section and the ground section have a combined overall width of from about 45 mm and a height of about 7 mm. Additionally, the antenna section and the ground section adhered to the substrate typically have a combined overall thickness of from about 0.05 mm to about 0.25 mm, and even more preferably a combined overall thickness of about 0.1-0.2 mm. The substrate typically is at least one of a Flame Retardant 4 material complying with a UL-94-V0 flammability standard, a flexible printed circuit substrate, and a single-side printed circuit board substrate. Moreover, the conductive layer is typically selected from the group comprising copper, aluminum, nickel, silver, and chrome. An insulation layer may also be provided on top of the conductive layer. The insulation layer can be configured such that it has an aperture defining a ground access point exposing a portion of the ground element. Additionally, the insulation layer can be configured to provide an aperture defining a feed point exposing a portion of the radiation element. The dual band operation of the antenna includes, for example, a first frequency from 2400-2500 MHz and a second frequency from 4900-6000 MHz.

Another aspect of the disclosure is directed to planar antennas manufactured by patterning a substrate comprising a dielectric layer, and a conductive layer applied to at least one surface of the substrate. Planar antennas manufactured by patterning a substrate comprise: a conductive layer attached to a first surface of the substrate wherein the conductive layer further comprises an antenna section which includes a ground section having a substantially rectangular shape with a U-shaped opening (female aperture) along one length in two dimensions, and an elongated radiation section configured to fit within the female aperture of the ground section at a first end and an arrowhead shape ("M"-shape or two Vs stacked) at a second end. Each of the antenna section and the ground section can be formed from a layer of patterned foil adhered to the first surface of the substrate. As shown, the antenna section and the ground section have a combined overall width of from about 30 mm to 58 mm and a height of from about 3 mm to about 15 mm, and more preferably the antenna section and the ground section have a combined overall width of from about 45 mm and a height of about 7 mm. Additionally, the antenna section and the ground section adhered to the substrate typically have a combined overall thickness of from about 0.05 mm to about 0.25 mm, and even more preferably a combined overall thickness of about 0.1-0.2 mm. The radiation element further comprises a first horizontally longer section at a first end and a parallel shorter section below the first horizontally longer section, wherein the second section is proximal the ground element. The substrate typically is at least one of a Flame Retardant 4 material, a flexible printed circuit substrate, and a single-side printed circuit board substrate. Moreover, the conductive layer is typically selected from the group comprising copper, aluminum, nickel, silver, and chrome. An insulation layer may also be provided on top of the conductive layer. The insulation layer can be configured such that it has an aperture defining a ground access point exposing a portion of the ground element. Additionally, the insulation layer can be configured to provide an aperture defining a feed point exposing a portion of the radiation element. The dual band operation of the antenna includes, for example, a first frequency from 2400-2500 MHz and a second frequency from 4900-6000 MHz.

Still another aspect of the disclosure is directed to an antenna kits which include one or more antennas. Antenna kits comprise: a planar antenna comprising a substrate a conductive layer attached to a first surface of the substrate wherein the conductive layer further comprises an antenna section which includes a ground section having a substantially rectangular shape with a U-shaped opening (female aperture) along one length in two dimensions, and an elongated radiation section configured to fit within the female aperture of the ground section at a first end and an arrowhead shape ("M"-shape or two Vs stacked) at a second end. Additionally, the kits can include other components such as a flexible cable adaptable to connect the planar antenna to a target device, and a planar antenna mounting material.

INCORPORATION BY REFERENCE

All publications, patents, and patent applications mentioned in this specification are herein incorporated by reference to the same extent as if each individual publication, patent, or patent application was specifically and individually indicated to be incorporated by reference.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings of which:

FIGS. 1*a-h* illustrate a planar antenna in accordance with the disclosure; FIG. 1*a* illustrates a top planar view of the antenna; FIG. 1*b* illustrates a cross-sectional side view along the lines 1*b*-1*b* of FIG. 1*a*; FIG. 1*c* illustrates a cross-sectional side view along the lines 1*c*-1*c* of FIG. 1*a*; FIG. 1*d* illustrates a cross-sectional side view along the lines 1*d*-1*d* of FIG. 1*a*; FIG. 1*e* illustrates a cross-sectional side view along the lines 1*e*-1*e* of FIG. 1*a*; FIG. 1*f* illustrates a cross-sectional side view along the lines 1*f*-1*f* of FIG. 1*a*; FIG. 1*g* illustrates a cross-sectional side view along the lines 1*g*-1*g* of FIG. 1*a*; FIG. 1*h* illustrates an expanded view of the substrate and antenna layers;

DETAILED DESCRIPTION OF THE INVENTION

The disclosure provides a coupled dual-band dipole antenna that has cancelled electromagnetic interference suitable for use in any wireless application, including, but not limited to those wireless applications which use 2400-2500 MHz and 4900-6000 MHz bands. Wireless applications include, for example, Wi-Fi™, wireless HDTV, Bluetooth, Public Safety, RFID, tolling, remote control and unlicensed band wireless applications.

Wi-Fi™ is a trademark of the Wi-Fi Alliance and typically refers only to a narrow range of connectivity technologies including wireless local area networks (WLAN) based on the IEEE 802.11 standards, device-to-device connectivity (such as Wi-Fi peer-to-peer), and a range of technologies that support personal area networks (PAN), local area networks (LAN) and WAN connections. Wi-Fi has become a superset of IEEE 802.11.

As will be appreciated by those skilled in the art, the disclosure herein enables an antenna with radiation control sections for performance adjustment. The antennas can operate in a dual-band mode while being simultaneously optimized to efficiently perform in two modes during operation. The antenna provides for dual-band wireless application which operate in the 2400-2500 MHz and 4900-6000 MHz bands.

I. Antennas

Figure 1A:
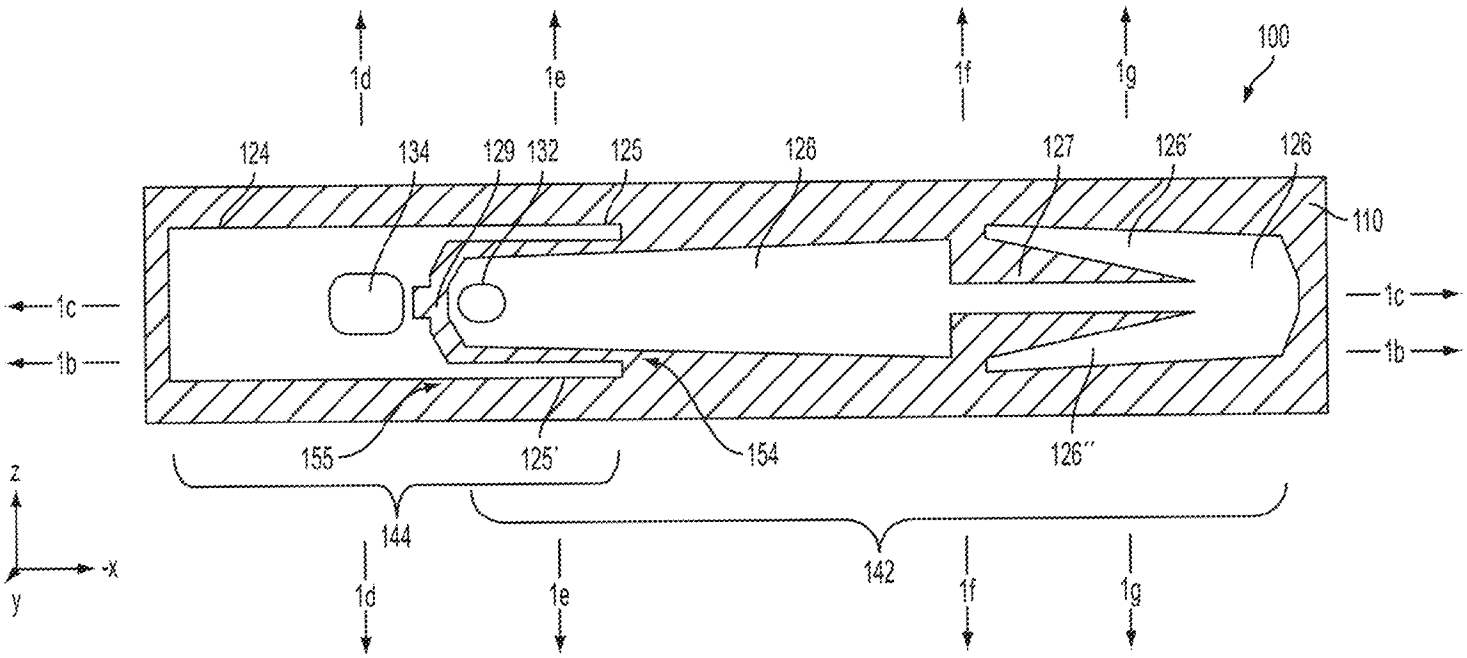

FIG. 1*a* illustrates a top view of a planar antenna. The antenna 100 has a planar antenna. As is illustrated, the antenna 100 has a ground element section 144 and an antenna section 142. Each of these sections—with its electrically conductive layer of a correspondingly specific shaping—is, typically, a layer of copper foil adhered to the surface of a suitable substrate 110.

The ground element 124 can further be masked by a protective layer 150 leaving only a ground access point 134 exposed. Similarly, the radiation element 122 of the antenna section 142 can be adapted and configured to provide an unmasked feed point 132. The ground access point 134 and feed point 132 provides a location for the antenna to achieve an electrical connection to the antenna circuitry of the electronic equipment relying on the antenna for electromagnetic signal transmission and reception.

The radiation element 122 is adhered to the substrate 110 and has an approximate shape is forms an arrowhead, "M" or two "V"s (dual-V) 126 at a first end (comprising two outer legs 126', 126" and a center post 127) and connected via the center post or narrowed neck 127 to a substantially rectangular shape 128 which tapers at its second end and is spaced from the ground section by a gap 129 at the end of the ground section 124. The ground element 124 has a substantially rectangular shape with a squared shape at a first end 154 and a female U-shaped opening 155 at a second end 156 forming two legs 125, 125' which is configured to fit around the substantially rectangular section 128 of the radiation section 122.

Figure 1B:
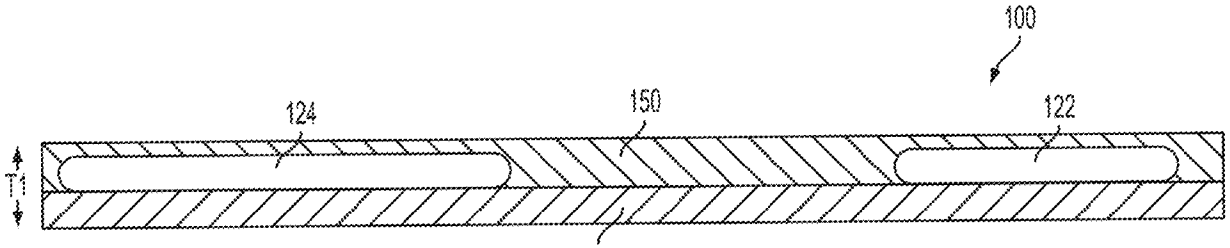

Turning now to FIGS. 1*b-h*, a substrate 110 is provided upon which the antenna element sits. A top insulation layer 150 can also be provided to electrically isolated, or selectively electrically isolated, the antenna element from the surrounding area. As shown in FIG. 1*b*, which is a cross-section of the antenna taken along the lines 1*b*-1*b* of FIG. 1*a*, the longer horizontal segments 154, 154' of the radiation element 122 and ground element 124 of the antenna sit atop the substrate 110 and are covered by an insulation layer 150. As can be seen in the cross-section shown in FIG. 1*c*, which is a cross-section of the antenna taken along the lines 1*c*-1*c* of FIG. 1*a*, the entire surface of the substrate 110 is covered the insulation layer 150 and ground access point 134 is exposed over the ground element 124 and the radiation element 122 is exposed at the unmasked feed point 132. Turning now to the cross-section shown in FIG. 1*d*, an opening in the insulation layer 150 is provided which provides a ground access point 134 to the ground element 12. The overall thickness T1 of the antenna ranges from 0.05 mm to 0.25 mm and more preferably about 0.1-0.2 mm.

As shown in the cross-section of FIG. 1*e*, the parallel legs 125, 125' of the ground element 124 are positioned in either side of the rectangular section of the radiation element 122. In FIG. 1*f*, he central post or neck 127 of the arrowhead, "M" or two "V"s (dual-V) portion of the radiation element 122 is positioned on the substrate 110 and covered by the insulation layer 150. FIG. 1*g* illustrates the two parallel outer legs 126', 126" of the arrowhead, "M" or two "V"s (dual-V) section 126 of the radiation element 122, with the central post or neck 127 positioned on the substrate 110 and covered by an insulation layer 150.

Figure 1H:
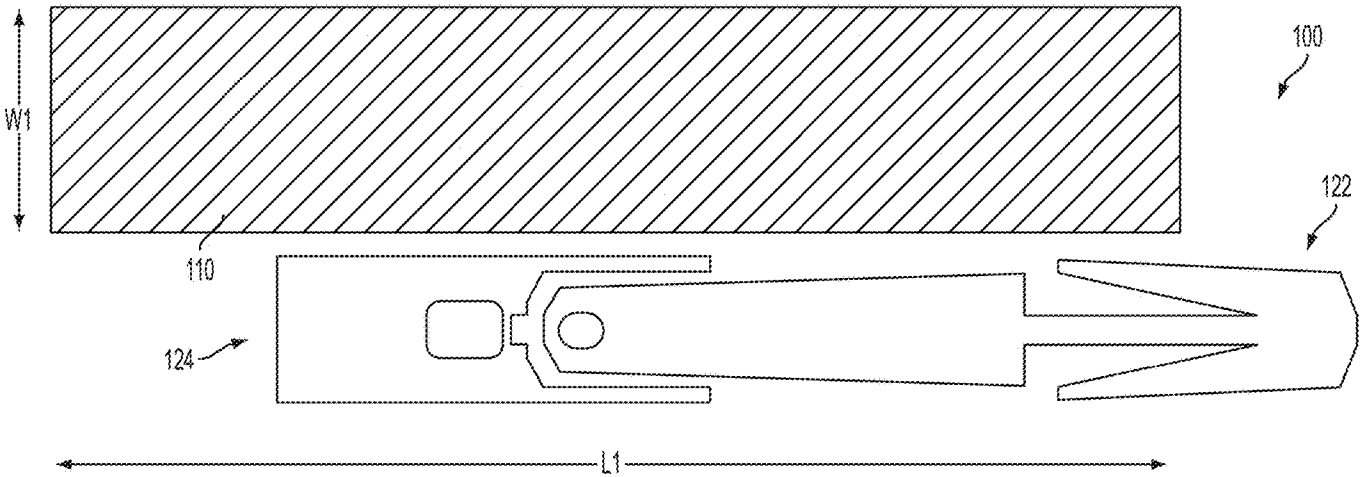

Turning now to FIG. 1*h*, the ground element 124 and radiation element 122 of suitable material, such as copper, is sized to be positioned on a substrate 110. The overall dimensions of the combined ground element 124 and radiation element 122 is L1 along one axis and W1 along a second access, where L1 typically ranges from 30 mm to 58 mm, more preferably from 40 mm to 45 mm, and even more preferably about 45 mm, and W1 typically ranges from 3 mm to 15 mm, more preferably from 5 mm to 9 mm, and even more preferably about 7 mm. The overall dimensions of the antenna is generally rectangular.

Figure 2:
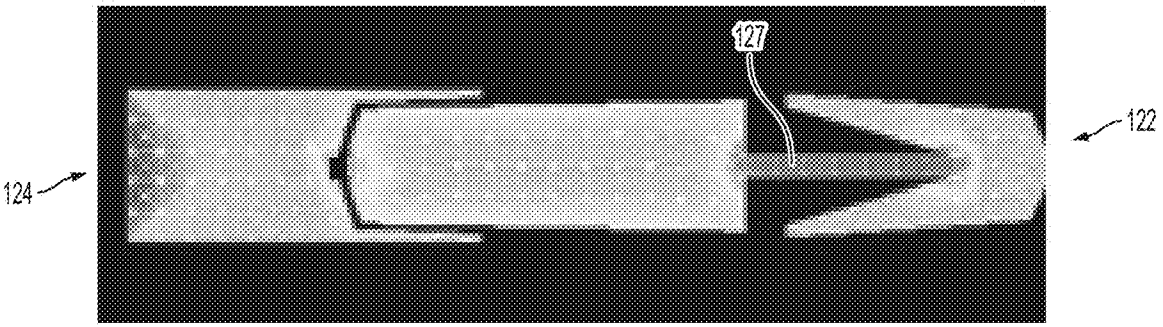
FIG. 2 shows the simulation result of current distribution for the antenna of FIGS. 1*a-h* working in the 2.4 GHz mode.
Figure 3:
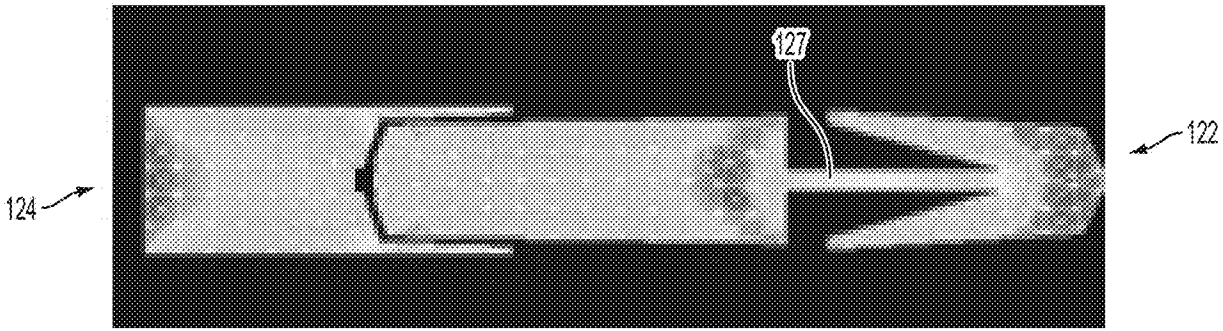
FIG. 3 shows the simulation result of current distribution for the antenna of FIGS. 1*a-h* working in the 5 GHz mode.

FIG. 2 shows the simulation result of current distribution for an antenna constructed according to FIGS. 1*a-h* wherein the antenna is operating in a 2.4 GHz Wi-Fi mode. FIG. 3 shows the simulation result of current distribution for an antenna of FIGS. 1*a-h* operating in a 5 GHz Wi-Fi mode. In FIG. 2, for example the current distribution is highest along the central post 127 of the antenna section 142 and along the squared end of the ground section 144 whereas in FIG. 3 the current distribution in the antenna section 142 has lowered and moved to the tip of the arrowhead, "M" or two "V"s (dual-V) and the section of the rectangular body closest to the central post 127, while the current distribution along the squared end of the ground section 144 has remained substantially the same.

Figure 4:
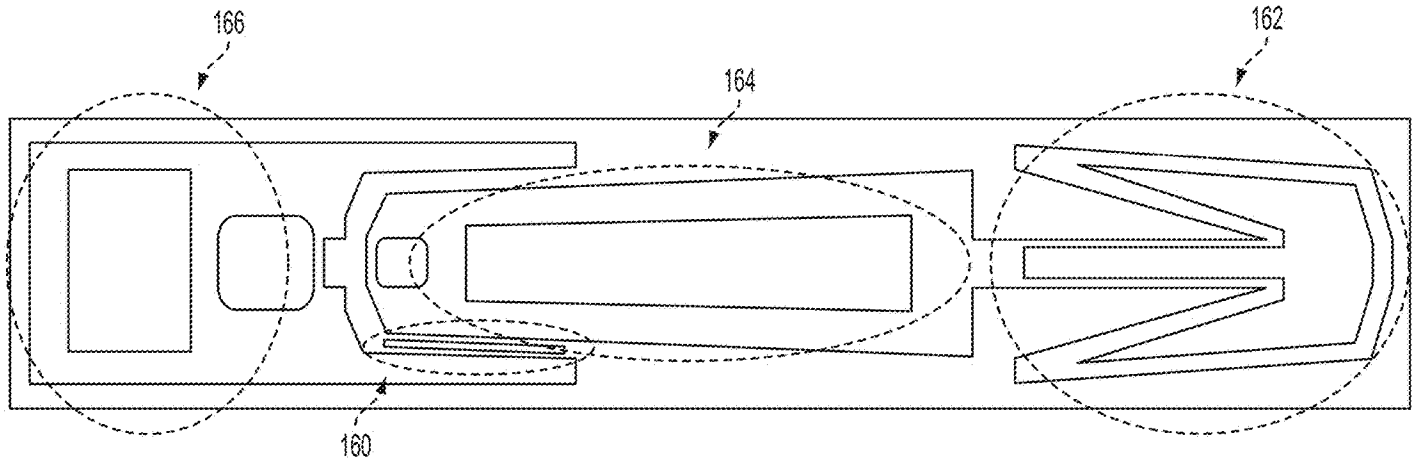
FIG. 4 illustrates an antenna segment responsible for bandwidth and efficiency adjustments of the antenna of FIGS. 1*a-h;*

FIG. 4 illustrates the antenna segments responsible for characteristics adjustment of the antenna of FIGS. 1*a-h*. According to the present disclosure, physical dimensions of several radiation control sections of the antenna copper patterning can be used as control factors for performance adjustment of antenna 100. For example, radiation control sections of the radiating element 122 generally indicated by phantom-lines 162, 164, 166 of the ground element 124. The distance between the short and long horizontal segments of the ground element 124, as well as spacing between the radiating element 122 and the ground element 124 can be used as control factors for the performance adjustment of antenna 100. Performance characteristics include, for example, the operating frequency bandwidth, the antenna electrical characteristics, and operating efficiency. These characteristics can be adjusted for the 2.4 and 5 GHz bands of the antenna 100 applications.

Dimensioning a radiation control section 162, basically the entire arrowhead, "M" or two "V"s (dual-V) 126 of the radiation element 122, can be altered to facilitate control of the center frequency, the bandwidth, the transmission efficiency and the impedance matching of the antenna for the 2.4 GHz mode of operation. Shaping of the two downward pointing tails 126', 126" of the arrowhead, "M" or two "V"s (dual-V) 126 controls the center frequency of 2.4 GHz operation, their width controls the bandwidth, and the narrowest width at the tails controls both the antenna efficiency and its impedance matching.

Moreover, the width of a second radiation control section 164 can be altered to facilitate the settlement of the antenna bandwidth in the 5 GHz mode of operation. Length (in the vertical direction in the illustration) of the radiation control section 164 can be altered to adjust impedance matching in the 5 GHz mode.

Still further, the radiation control section 166 of the ground element 124 can be altered by changing the separation gap 129 between the radiation element 122 and ground element 124 which is a factor to control and adjust the antenna efficiency in high-frequency operations. Radiation control section 166 is essentially a base portion of the ground element 124, and provides a surface area for the antenna 100 in electrical connection (not necessarily via soldering) with a relatively larger metallic conductor or a metallic plate in order to improve overall antenna operation efficiency. The radiation control section 162 of the radiation element 122 can function as the radiation body for the antenna 100 in the 2.4 GHz mode of operation while the second radiation control section 164 of the radiation element 122 functions in the 5 GHz mode. Antenna 100, essentially, is one featuring at least two bands: a lower band and a higher band. For example, a first lower band could be 2.4 GHz and a second higher band could be 5 GHz. The two bands are tied together in series. This complementary antenna 100 therefore presents a shape in terms of its copper pattern that has a double-V feature.

As discussed above, a monopole antenna 100 has an overall antenna expansion of grossly 45 mm in the lengthwise direction and a width of grossly 7 mm deployed on a substrate of a thickness of 0.1 mm.

II. Operation and Use of the Antennas

The antenna can be provided with a flexible cable adapted and configured to connect the antenna to the electronics of the target device, such as a mobile phone. Alternatively, the antenna can be configured such that no cable is required to connect the antenna to the target device. For a cable-less antenna, pads are provided on the antenna which provide connections from a module or transmission line via metal contacts or reflow solder.

The antenna can be affixed to a housing of a target device, such as an interior surface of a cell phone housing. Affixing the antenna can be achieved by using suitable double sided adhesive, such as 3M™ Adhesive Transfer Tape 467MP available from 3M.

As will be appreciated by those skilled in the art, the larger the antenna surface area (or volume), in general the higher the performance in terms of gain and radiation characteristics. Additionally, the gain of the antenna is closely linked to the surface area or volume of the antenna. Thus, the larger the surface area or volume, the higher the gain. In deploying the antenna, clearances can be provided to optimize performance of the antenna. As will be appreciated by those skilled in the art, the larger the clearance, the better the radiation characteristics of the antenna.

III. Method of Manufacturing the Antennas

The features and functions of the antennas described herein allow for their use in many different manufacturing configurations. For example, in a wireless communication handheld device (e.g. a mobile phone), an antenna can be printed on any suitable substrate including, for example, printed circuit boards (PCB) or flexible printed circuits (FPC). The PCB or FPC is then used to mechanically support and electrically connect the antenna to the electronics of the device deploying the antenna using conductive pathways. tracks or signal traces etched from copper sheets, for example, that has been laminated onto a non-conductive substrate. The printed piece can then be mounted either at the top of the handset backside or at the bottom of the front side of the handset. Thus, antennas 100 according to this disclosure can be manufactured, for example, using a standard low-cost technique for the fabrication of a single-side printed circuit board. Other manufacturing techniques may be used without departing from the scope of the disclosure.

Techniques for manufacturing antennas include determining which materials, processes will be followed. For example, a printed circuit board (PCB), an electrically thin dielectric substrate (e.g., RT/diroid 5880), Flame Retardant 4 (FR-4) material complying with the UL-94-V0, or any suitable non-conductive board can be used as the substrate. A conductive layer is provided from which the antenna will be formed. The conductive layer is generally copper, but other materials can be used without departing from the scope of the disclosure. For example, aluminum, chrome, and other metals or metal alloys can be used.

Data for identifying a configuration for the antenna layer is provided which can then be placed onto an etch resistant film that is placed on the conductive layer which will form the antenna. A traditional process of exposing the conductive layer, and any other areas unprotected by the etch resistant film, to a chemical that removes the unprotected conductive layer, leaving the protected conductive layer in place. As will be appreciated by those skilled in the art, newer processes that use plasma/laser etching instead of chemicals to remove the conductive material, thereby allowing finer line definitions, can be used without departing from the scope of the disclosure.

Multilayer pressing can also be employed which is a process of aligning the conductive material and insulating dielectric material and pressing them under heat to activate an adhesive in the dielectric material to form a solid board material. In some instances, holes can be drilled for plated through applications and a second drilling process can be used for holes that are not to be plated through.

Plating, such as copper plating, can be applied to pads, traces, and drilled through holes that are to be plated through. The antenna boards can then be placed in an electrically charged bath of copper. A second drilling can be performed if required. A protective masking material can then be applied over all or select portions of the bare conductive material. The insulation protects against environmental damage, provides insulation, and protects against shorts. Coating can also be applied, if desired. As a final step, the markings for antenna designations and outlines can be silk-screened onto the antenna. Where multiple antennas are manufactured from a panel of identical antennas, the antennas can be separated by routing. This routing process also allows cutting notches or slots into the antenna if required.

As will be appreciated by those skilled in the art, a quality control process is typically performed at the end of the process which includes, for example, a visual inspection of the antennas. Additionally, the process can include the process of inspecting wall by cross-sectioning or other methods. The antennas can also be checked for continuity or shorted connections by, for example, applying a voltage between various points on the antenna and determining if a current flow occurs. The correct impedance of the antennas at each frequency point can be checked by connecting to a network analyzer.

IV. Kits

The antennas disclosed herein can be made available as part of a kit. The kit comprises, for example, a planar antenna comprising a substrate a conductive layer attached to a first surface of the substrate wherein the conductive layer further comprises an antenna section which includes a ground section having a substantially rectangular shape with a U-shaped opening (female aperture) along one length in two dimensions, and an elongated radiation section configured to fit within the female aperture of the ground section at a first end and an arrowhead shape ("M"-shape or two-V's) at a second end. Additionally, the kit may include, for example, suitable mounting material, such as 3M adhesive transfer tape. Other components can be provided in the kit as well to facilitate installation of the antenna in a target device, such as a flexible cable. The kit can be packaged in suitable packaging to allow transport. Additionally, the kit can include multiple antennas, such that antennas and cables are provided as 10 packs, 50 packs, 100 packs, and the like.

V. Examples

Figure 5:
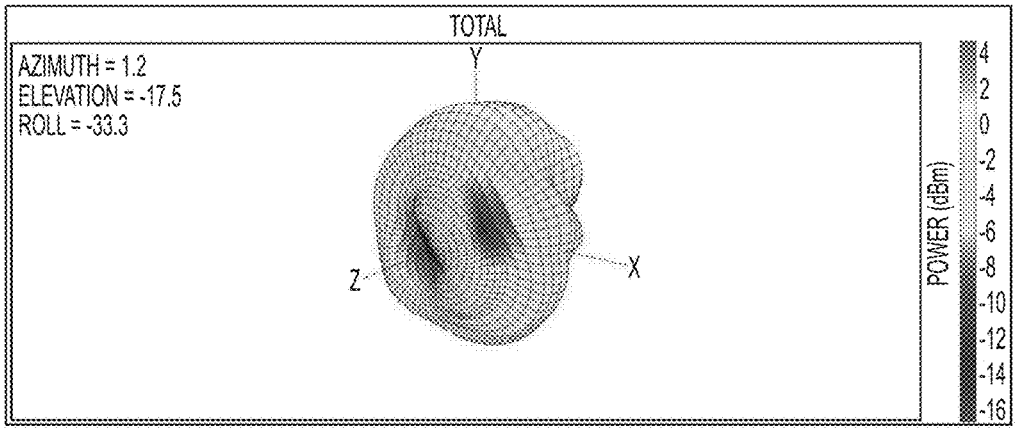
FIG. 5 shows the gain characteristic of the antenna of FIGS. 1*a-h* working under the 2.4 GHz mode.
Figure 6:
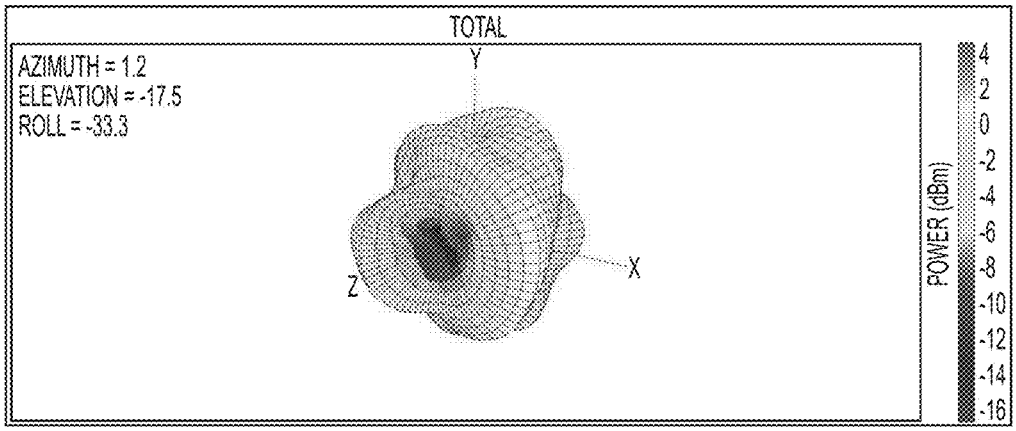
FIG. 6 shows the gain characteristic of the antenna of FIGS. 1*a-h* working under the 5 GHz mode.

Experimental antennas according to this disclosure have been constructed and tested. FIG. 5 shows an actual measured gain characteristic of an embodiment of an antenna 100 using a lower band and an upper band operating in the 2.4 GHz Wi-Fi mode, and FIG. 6 shows a gain characteristic of the same antenna operating in the 5 GHz Wi-Fi mode with a power range measurement from −16 dMB (violet) to 4 dMb (red) where dBm is a power level in decibels relative to 1 Watt. Antenna 100 was tested in a lab with an antenna 100 orientation as described in FIG. 4. TABLE 1 lists the performance specification of the antenna measured in FIGS. 5 and 6.

TABLE 1

SPECIFICATION OF AN EXPERIMENTAL ANTENNA

| Standard | Bluetooth | 2.4 GHz Wi-Fi | 5 GHz Wi-Fi | Other 5 GHz |
|---|---|---|---|---|
| Band (MHz) | 2,401-2,480 | 2,400-2,500 | 5,725-5,825 | 4,900-5,900 |
| Peak Gain (dBi) | 2 | 2 | 2 | 2 |
| Average Gain | −2~−3 | | −2~−4 | |
| Efficiency (%) | 50-60% | | 40-55% | |

As discussed above, the gain of the antenna is closely linked to the surface area or volume of the antenna. Moreover, the antenna efficiency directly relates to the actual measured radiated power and sensitivity of the wireless device it is placed into (the TRP/TIS results). The higher the efficiency, given a well matched antenna and device, the better the range and sensitivity of the device, the higher the data transfer speed, and the less power is consumed by the device. For antennas built under the designs disclosed herein, the efficiency remains high in both the 2.4 GHz and 5 GHz ranges, given the relatively small size of the antenna.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

What is claimed is:

1. A planar antenna comprising:

a substrate having a length greater than a width;

a conductive layer attached to a first surface of the substrate wherein the conductive layer further comprises a first radiation control section operating at a first bandwidth and connected in series via a central post with a second radiation control section operating at a second bandwidth different than the first bandwidth, and a ground section having a rectangularly-shaped pattern with a U-shaped opening at one end thereof positioned around a portion of the second radiation control section, wherein the planar antenna has a current distribution that has a first maxima along the central post and a second maxima at a squared end of the rectangularly shaped pattern of the ground section.

2. The planar antenna of claim 1 wherein each of the antenna section and the ground section is a layer of patterned foil adhered to the first surface of the substrate.

3. The planar antenna of claim 1 wherein the antenna section and the ground section have a combined overall width of from about 30 mm to 58 mm and a height of from about 3 mm to about 15 mm.

4. The planar antenna of claim 1 wherein the antenna section and the ground section have a combined overall width of from about 45 mm and a height of about 7 mm.

5. The planar antenna of claim 1 wherein the antenna section and the ground section adhered to the substrate have a combined overall thickness of from about 0.05 mm to about 0.25 mm.

6. The planar antenna of claim 1 wherein the antenna section and the ground section adhered to the substrate have a combined overall thickness of about 0.1 mm to 0.1 mm.

7. The planar antenna of claim 1 wherein the substrate is at least one of a Flame Retardant 4 material, a flexible printed circuit substrate, and a single-side printed circuit board substrate.

8. The planar antenna of claim 1 wherein the conductive layer is selected from the group comprising copper, aluminum, nickel, silver, and chrome.

9. The planar antenna of claim 1 further comprising an insulation layer on top of the conductive layer.

10. The planar antenna of claim 9 wherein the insulation layer has an aperture defining a ground access point exposing a portion of the ground section.

11. The planar antenna of claim 9 wherein the insulation layer has an aperture defining a feed point exposing a portion of the second radiation control section element.

12. The planar antenna of claim 1 wherein the dual band includes a first frequency from 2400-2500 MHz and a second frequency from 4900-6000 MHz.

13. A planar antenna manufactured by patterning a substrate comprising a dielectric layer, and a conductive layer applied to at least one surface of the substrate, comprising:

a conductive layer attached to a first surface of the substrate wherein the conductive layer further comprises a first radiation control section operating at a first bandwidth and connected in series via a central post with a second radiation control section operating at a second bandwidth different than the first bandwidth, and a ground section having a rectangularly-shaped pattern with a U-shaped opening at one end thereof positioned around a portion of the second radiation control section, wherein the planar antenna has a current distribution that has a first maxima along the central post and a second maxima at a squared end of the rectangularly shaped pattern of the ground section, wherein the substrate has a substantially rectangular shape.

14. The planar antenna of claim 13 wherein each of the antenna section and the ground section is a layer of patterned foil adhered to the first surface of the substrate.

15. The planar antenna of claim 13 wherein the antenna section and the ground section have a combined overall width of from about 30 mm to 58 mm and a height of from about 3 mm to about 15 mm.

16. The planar antenna of claim 13 wherein the antenna section and the ground section have a combined overall width of from about 45 mm and a height of about 7 mm.

17. The planar antenna of claim 13 wherein the antenna section and the ground section adhered to the substrate have a combined overall thickness of from about 0.05 mm to about 0.25 mm.

18. The planar antenna of claim 13 wherein the antenna section and the ground section adhered to the substrate have a combined overall thickness of about 0.1 mm-0.2 mm.

19. The planar antenna of claim 13 wherein the antenna section has a radiation element further comprising a first horizontally longer section at a first end and a parallel shorter section below the first horizontally longer section, wherein the second section is proximal the ground section.

20. The planar antenna of claim 13 wherein the substrate is at least one of a Flame Retardant 4 material, a flexible printed circuit substrate, and a single-side printed circuit board substrate.

21. The planar antenna of claim 13 wherein the conductive layer is selected from the group comprising copper, aluminum, nickel, silver, and chrome.

22. The planar antenna of claim 13 further comprising an insulation layer on top of the conductive layer.

23. The planar antenna of claim 22 wherein the insulation layer has an aperture defining a ground access point exposing a portion of the ground section.

24. The planar antenna of claim 22 wherein the insulation layer has an aperture defining a feed point exposing a portion of second radiation control section.

25. The planar antenna of claim 13 wherein the dual band includes a first frequency from 2400-2500 MHz and a second frequency from 4900-6000 MHz.

26. An antenna kit comprising:

a planar antenna comprising a conductive layer attached to a first surface of the substrate wherein the conductive layer further comprises a first radiation control section operating at a first bandwidth and connected in series via a central post with a second radiation control section operating at a second bandwidth different than the first bandwidth, and a ground section having a rectangularly-shaped pattern with a U-shaped opening at one end thereof positioned around a portion of the second radiation control section, wherein the planar antenna has a current distribution that has a first maxima along the central post and a second maxima at a squared end of the rectangularly shaped pattern of the ground section.

27. The antenna kit of claim 26 further comprising a flexible cable adaptable to connect the planar antenna to a target device.

28. The antenna kit of claim 26 further comprising a planar antenna mounting material.

* * * * *